US008099012B2

(12) United States Patent
Askren et al.

(10) Patent No.: US 8,099,012 B2
(45) Date of Patent: Jan. 17, 2012

(54) DEVELOPER ROLL LIP SEAL

(75) Inventors: Benjamin Alan Askren, Lexington, KY (US); Donn Duane Bryant, Lexington, KY (US); Benjamin Erich Kant, Lexington, KY (US); Lenci Robert Kappes, Kalispell, MT (US); Michael Craig Leemhuis, Nicholasville, KY (US)

(73) Assignee: Lexmark International, Inc., Lexington, KY (US)

( * ) Notice: Subject to any disclaimer, the term of this patent is extended or adjusted under 35 U.S.C. 154(b) by 1001 days.

(21) Appl. No.: 11/959,058

(22) Filed: Dec. 18, 2007

(65) Prior Publication Data

US 2009/0154951 A1 Jun. 18, 2009

(51) Int. Cl.
*G03G 15/08* (2006.01)

(52) U.S. Cl. ..... 399/103

(58) Field of Classification Search ..... 399/103, 399/102, 104–106, 284
See application file for complete search history.

(56) References Cited

U.S. PATENT DOCUMENTS

| | | | |
|---|---|---|---|
| 3,809,012 | A | 5/1974 | Delvecchio |
| 3,985,436 | A | 10/1976 | Tanaka et al. |
| 4,218,131 | A | 8/1980 | Ito et al. |
| 4,400,082 | A | 8/1983 | Kiba |
| 4,498,760 | A | 2/1985 | Sugiyama |
| 4,500,195 | A | 2/1985 | Hosono |
| 4,540,268 | A | 9/1985 | Toyono et al. |
| 4,564,283 | A | 1/1986 | Fox et al. |
| 4,616,919 | A | 10/1986 | Adley et al. |
| 4,627,701 | A | 12/1986 | Onoda et al. |
| 4,681,426 | A | 7/1987 | Bean et al. |
| 4,779,119 | A | 10/1988 | Kaieda |
| 4,791,454 | A | 12/1988 | Takahashi et al. |
| 4,802,928 | A | 2/1989 | Dunlap |
| 4,819,030 | A | 4/1989 | Shibano |
| 4,821,672 | A | 4/1989 | Bruno |
| 4,862,209 | A | 8/1989 | Sakamoto et al. |
| 4,870,449 | A | 9/1989 | Brown |
| 4,893,151 | A | 1/1990 | Yamazaki |
| 4,905,047 | A | 2/1990 | Ariyama |
| 4,937,632 | A | 6/1990 | Kamidaira |
| 4,947,216 | A | 8/1990 | Surti |
| 5,021,830 | A | 6/1991 | Koiso |

(Continued)

FOREIGN PATENT DOCUMENTS

JP 2001-134081 A 5/2001

OTHER PUBLICATIONS

International Search Report and Written Opinion of the International Searching Authority dated Feb. 17, 2009 for PCT Application No. PCT/US2008/087534.

(Continued)

*Primary Examiner* — David Porta
*Assistant Examiner* — Marcus Taningco
(74) *Attorney, Agent, or Firm* — John Victor Pezdek; James E. Cole

(57) ABSTRACT

A toner seal comprises a j-shaped seal having an upper seat portion and a leg portion, the leg having a front face extending between first and second edges of said leg portion, a lip seal extending along at least one of the first and second edges of the leg, and, the lip seal having a length extending from the upper seat portion along the leg.

21 Claims, 10 Drawing Sheets

U.S. PATENT DOCUMENTS 5,029,316 A 7/1991 Koiso
5,150,651 A 9/1992 Flores
5,202,729 A 4/1993 Miyamoto et al.
RE34,384 E 9/1993 Ishiguro et al.
5,321,473 A 6/1994 Azami
5,369,477 A 11/1994 Foote et al.
5,404,216 A 4/1995 Numagami et al.
5,455,665 A 10/1995 Baba et al.
5,475,467 A 12/1995 Watanabe et al.
5,488,462 A 1/1996 Ishikawa et al.
5,502,547 A 3/1996 Shirai
5,550,617 A 8/1996 Odagawa et al.
5,585,895 A 12/1996 Yashiro et al.
5,655,178 A 8/1997 Ishikawa et al.
5,671,673 A 9/1997 Boose et al.
5,697,021 A 12/1997 Watanabe et al.
5,697,022 A 12/1997 Matsuda et al.
5,701,558 A 12/1997 Kojima
5,758,230 A 5/1998 Nakaue et al.
5,774,765 A 6/1998 Hirota et al.
5,778,282 A 7/1998 Nagashima
5,805,958 A 9/1998 Fisk
5,805,965 A 9/1998 Tsuda et al.
5,809,374 A 9/1998 Tsuda et al.
5,870,651 A 2/1999 Shimada
5,875,378 A 2/1999 Campbell et al.
5,895,144 A 4/1999 Nishimura
5,895,151 A 4/1999 Kinoshita et al.
5,937,237 A 8/1999 Nonaka et al.
5,946,530 A 8/1999 Tsuji et al.
5,987,277 A 11/1999 Okabe
5,995,774 A 11/1999 Applegate et al.
6,009,285 A 12/1999 Barry et al.
6,021,297 A 2/2000 Campbell et al.
6,035,158 A 3/2000 Asakura et al.
6,049,689 A 4/2000 Ishii et al.
6,070,027 A 5/2000 Kawai et al.
6,071,660 A 6/2000 Black et al.
6,078,763 A 6/2000 Hoshi
6,078,771 A 6/2000 Buchanan et al.
6,094,550 A 7/2000 Kido et al.
6,104,894 A * 8/2000 Sato et al. ..... 399/106
6,115,565 A 9/2000 Noda
6,178,301 B1 1/2001 Kojima et al.
6,181,897 B1 1/2001 Kawai
6,185,392 B1 2/2001 Hoshi
6,195,515 B1 2/2001 Fujita et al.
6,205,304 B1 3/2001 Kawaguchi
6,212,343 B1 4/2001 Hosokawa et al.
6,341,206 B1 1/2002 Yamaguchi et al.
6,471,773 B1 10/2002 Atkins
6,487,383 B2 11/2002 Buchanan et al.
6,553,195 B2 4/2003 Korfhage et al.
6,574,444 B2 6/2003 Uehara et al.
6,629,496 B1 10/2003 Boose et al.
6,643,481 B2 11/2003 Higeta et al.
6,671,473 B2 12/2003 Miyabe
6,690,900 B2 2/2004 Dougherty et al.
6,697,594 B1 2/2004 Murphy et al.
6,832,551 B2 12/2004 Jendroska et al.
6,842,595 B1 1/2005 McIver et al.
6,901,228 B2 5/2005 Kamimura et al.
7,062,195 B2 6/2006 Kurihara et al.
7,076,185 B2 7/2006 Okamoto
7,177,565 B1 * 2/2007 Miller ..... 399/103
2002/0090226 A1 7/2002 Sato et al.
2002/0150402 A1 * 10/2002 Buchanan et al. ..... 399/103
2003/0235438 A1 12/2003 Tatsumi
2004/0131839 A1 7/2004 Eagle
2005/0013890 A1 1/2005 Chapman et al.
2005/0158070 A1 7/2005 Ishii
2007/0034099 A1 2/2007 Gayne
2007/0034100 A1 2/2007 Gayne
2007/0134020 A1 6/2007 Lee et al.

OTHER PUBLICATIONS

Prosecution file history of co-pending U.S. Appl. No. 11/959,016 including the Non-Final Office Action dated Mar. 28, 2011, the response filed Jun. 28, 2011 and the Notice of Allowance dated Jul. 22, 2011.

* cited by examiner

DEVELOPER ROLL LIP SEAL

CROSS REFERENCES TO RELATED APPLICATIONS

This patent application is related to the U.S. patent application Ser. No. 11/959,016, filed even date herewith, entitled "Upper Seal for Inhibiting Doctor Blade Toner Leakage" and assigned to the assignee of the present application. The upper seal disclosed in this related application may be used in combination with the lip seal disclosed herein but it may also be used independently of this lip seal.

STATEMENT REGARDING FEDERALLY SPONSORED RESEARCH OR DEVELOPMENT

None.

REFERENCE TO SEQUENTIAL LISTING, ETC.

None.

BACKGROUND

1. Field of the Invention

The present invention relates to a seal which inhibits the leakage of toner between a cartridge housing and both a doctor blade assembly and a developer roll in a toner cartridge for a laser printer.

2. Description of the Related Art

Laser printers utilize a light beam which is focused to expose a discrete portion of a photoreceptive or image transfer drum in a further attempt to attract printing toner to these discrete portions. One component of a laser printer is the photoreceptive drum assembly. This photoreceptive drum assembly is made out of highly photoconductive material that is discharged by light photons typically embodied by a laser. Initially, the drum is given a charge by a charge roller. As the photoreceptive drum revolves, the printer shines a laser beam across the surface to discharge certain points. In this way, the laser "draws" the letters and images to be printed as a pattern of electrical charges—an electrostatic latent image. The system can also work with either a more positively charged electrostatic latent image on more negatively charged background or a more negative charged electrostatic latent image on a more positively charged background.

The printer's laser or laser scanning assembly draws the image to be printed on the photoreceptive drum. The traditional laser scanning assembly may include a laser, a movable mirror and a lens. The laser receives the image data defined by pixels that make up the text and images one horizontal line at a time. As the beam moves across the drum, the laser emits a pulse of light for every pixel to be printed. Typically, the laser doesn't actually move the beam. Instead, the laser reflects the light beam off of a movable mirror. As the mirror moves, the light beam passes through a series of lenses. This system compensates for the image distortion caused by the varying distance between the mirror and points along the drum. The laser assembly moves in one plane horizontally as the photoreceptor drum continuously rotates so the laser assembly can draw the next line. A print controller synchronizes this activity. The process of forming the light image on the photoreceptive drum discharges those areas where the image is formed.

When the toner becomes electrostatically charged, the toner is attracted to exposed portions of the image transfer drum. After the data image pattern is set, charged toner is supplied to the photoconductive drum. Because of the charge differential, the toner is attracted to and clings to the discharged areas of the drum, but not to the similarly charged "background" portions of the photoconductive drum. Toner is an electrostatically charged powder with two main ingredients, pigment and plastic. The pigment provides the coloring, such as black in a monochrome printer to form text and images. This pigment is blended with plastic particles, so the toner will melt when passing through the heat of a fuser assembly. The toner is stored in the toner cartridge housing, a small container built into a removable casing. The printer gathers the toner from a sump within the housing and supplies it to a developer unit using paddles and transfer rollers. The developer roll is a charged rotating roller, typically with a conductive metal shaft and a polymeric conductive coating, which receives toner from a toner adder roll positioned adjacent the developer roll. Due to electrical charge and mechanical scrubbing, the developer roll collects toner particles from the toner adder roll. A doctor blade assembly engages the developer roll to provide a consistent coating of toner along the length and surface of developer roll, by scraping or "doctoring" excess toner from the developer roll. The doctor blade may also induce a charge on the toner. In turn, this provides a consistent supply of toner to the photoconductive drum. When the coating of toner on the developer roll is inconsistent, too thick, too thin or bare, coating of the photoconductive drum is inconsistent and the level of darkness of the printed image may vary unintentionally, which is considered a print defect.

The electrostatic image on the photoconductive drum is charged such that the toner particles move from the developer roll onto the latent image on photoconductive drum. With the image data toner pattern on the photoconductive drum, the drum engages a sheet of paper or media moving adjacent thereto. The paper or other media is driven by a transport belt, which is oppositely charged to the toner causing it to transfer to the paper or other media. This charge is stronger than the charge of the electrostatic image, so the paper can pull the toner powder away from the surface of the photoconductive drum. When a medium, such as printing paper, passes beneath the rotating photoconductive drum, the toner is transferred to the medium. Since it is moving at the same speed as the drum, the paper picks up the image pattern exactly.

One problem area of toner leakage is a path along portions of the developer roll where the j-seal slidably engages the developer roll particularly where the developer roll, doctor blade, and j-seal all meet. These locations are difficult to seal due to the tolerances, stiffness, and deflections of the aforementioned components. Merely increasing the interference between the developer roll and j-seal would produce unacceptable torque for the motors to handle and heat generation for the toner to endure. It would be desirable that a balance of sealing performance, torque, and heat generation be maintained. Toner leakages occur due to the function of various components. For example, paddles that move the toner from the sump to the developing components of the cartridge cause a cyclical internal toner pressure in the cartridge. The operational toner pressure as well as vibration and drop testing has demonstrated this area around the surface of the developer roll and the j-seal to be a frequent toner leak path, especially in higher volume developer housings.

It would be desirable to inhibit toner leakage in the area of the developer roll and the doctor blade at the j-seal without adding additional parts or increasing expense through additional components to seal this area.

SUMMARY OF THE INVENTION

A toner seal comprises a j-shaped seal having an upper seat portion and a leg portion, the leg having a front face extending between first and second edges of said leg portion, a lip seal extending along at least one of the first and second edges of the leg, and, the lip seal having a length extending from the upper seat portion along the leg. The lip seal is connected to an upper seal wall. The lip seal has a length extending from the upper seat portion to a location short of an opposite end of the leg. The j-shaped seal is formed of an elastomeric material. The lip seal extends beyond the front face a distance of about 0.3 millimeters wherein the distance is a dimension measured extending radially from the face of the leg. In the toner seal one of the first edge and the second edge is an outside edge.

A toner seal for a j-seal disposed within a toner housing and engaging a developer roll comprises a j-shaped seal having an upper seat portion and a leg portion, the leg having a inner edge and an outer edge and a face extending between the outer and inner edges, a plurality of grooves along the face, and, a lip seal extending from the inner edge, the lip seal receiving a force from internal pressure of the toner housing and sealably engaging the developer roll and a doctor blade. The lip seal extends a distance above the face ranging from about 0.15 to about 0.5 millimeters. The distance of said lip seal is about 0.3 millimeters. The lip seal having a length extending from the seat to an opposite end of the leg. The lip seal engages a peripheral surface of the developer roll. The toner seal further comprises an inner seal and an outer seal extending from the upper seat portion.

A toner seal structure comprises a curvilinear seal having an upper seat and a leg depending from the seat, the leg having an outer edge, an inner edge, a face extending between the inner edge and the outer edge, and a curved portion, a lip seal extending from the upper seat to the curvilinear leg, the lip seal extending from the face along the outer edge of the leg. The toner seal further comprises a plurality of grooves located on the face of the leg. The toner seal wherein the curvilinear seal structure is molded. The lip seal extends from the face for slidably engaging a developer roll surface. The lip seal is raised from the face and may be disposed at an angle from the face, the angle being between about 90 degrees and 180 from the face and more advantageously the angle is between about 120 degrees and 150 degrees from the face.

BRIEF DESCRIPTION OF THE DRAWINGS

The aforementioned features and advantages of this invention, and the manner of attaining them, will become more apparent and the invention will be better understood by reference to the following description of embodiments of the invention taken in conjunction with the accompanying drawings, wherein.

DETAILED DESCRIPTION

Figure 1:
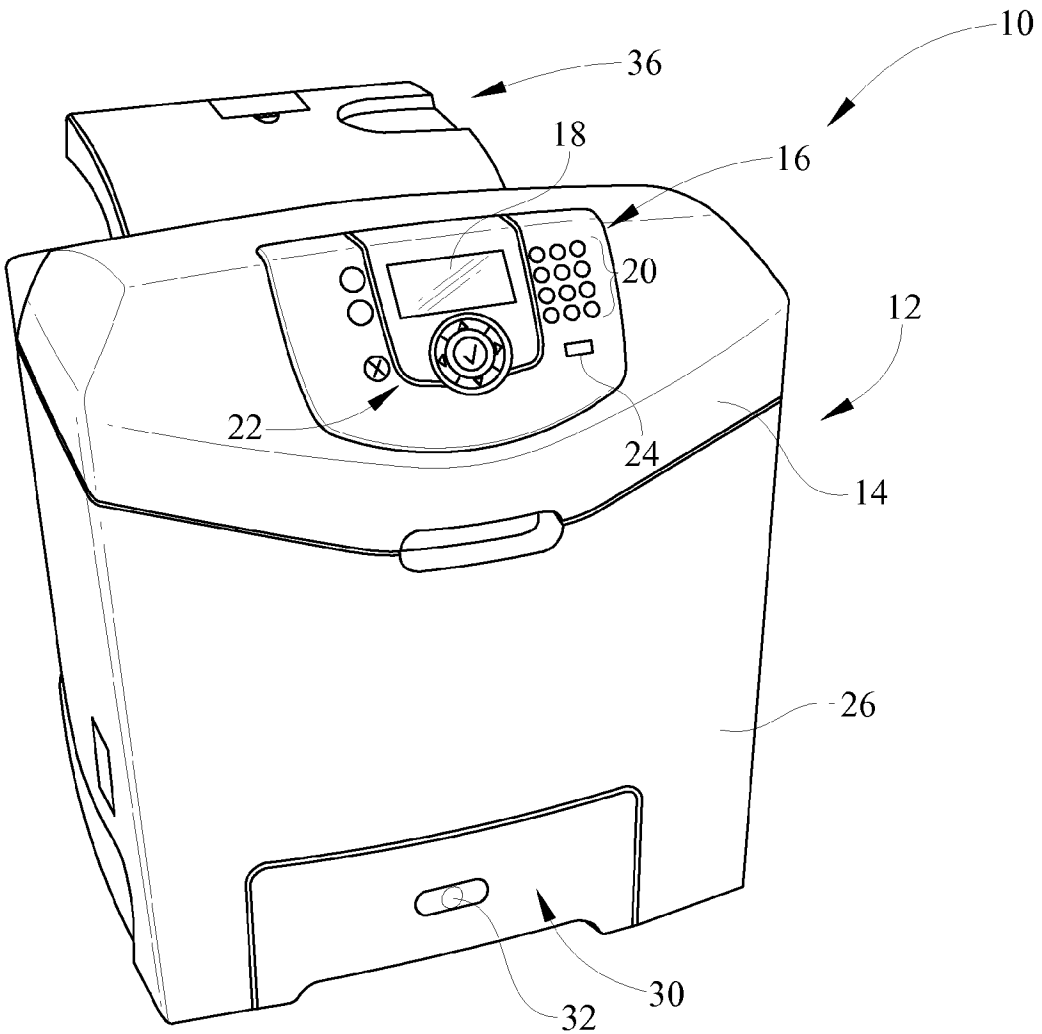
FIG. 1 depicts an exemplary electrophotographic printer.

The following description and drawings illustrate embodiments of the invention sufficiently to enable those skilled in the art to practice it. It is to be understood that the invention is not limited in its application to the details of construction and the arrangement of components set forth in the following description or illustrated in the drawings. The invention is capable of other embodiments and of being practiced or of being carried out in various ways. For example, other embodiments may incorporate structural, chronological, electrical, process, and other changes. Examples merely typify possible variations. Individual components and functions are optional unless explicitly required, and the sequence of operations may vary. Portions and features of some embodiments may be included in or substituted for those of others. The scope of the invention encompasses the appended claims and all available equivalents. The following description is, therefore, not to be taken in a limited sense, and the scope of the present invention as defined by the appended claims.

Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

In addition, it should be understood that embodiments of the invention include both hardware and electronic components or modules that, for purposes of discussion, may be illustrated and described as if the majority of the components were implemented solely in hardware. However, one of ordinary skill in the art, and based on a reading of this detailed description, would recognize that, in at least one embodiment, the electronic based aspects of the invention may be implemented in software. As such, it should be noted that a plurality of hardware and software-based devices, as well as a plurality of different structural components may be utilized to implement the invention. Furthermore, and as described in subsequent paragraphs, the specific mechanical configurations illustrated in the drawings are intended to exemplify embodiments of the invention and that other alternative mechanical configurations are possible.

The term image as used herein encompasses any printed or digital form of text, graphic, or combination thereof. The term output as used herein encompasses output from any printing device such as color and black-and-white copiers, color and black-and-white printers, and so-called "all-in-one devices" that incorporate two or more functions such as scanning, copying, printing, and faxing capabilities in one device. Such printing devices may utilize ink jet, dot matrix, dye sublimation, laser, and any other suitable print formats. The term button as used herein means any component, whether a physical component or graphic user interface icon, that is engaged to initiate output. The term media and paper may be used interchangeably herein and may include plain paper, glossy photo paper, coated paper, card stock, index cards, labels, envelopes, transparency, MYLAR, fabric, or other printable materials. The term operations panel, as used herein, means an interactive display allowing for menu display, menu selections, image viewing, editing of images, correction of error conditions and other operations and control functions. The term peripheral may include a single function or multi-function, or all-in-one, device which may be connected to a host computer, network connected or may be a stand-alone, which is a device which may function independently of any host computer.

The exemplary embodiments described herein provide a lip seal which inhibits toner leakage from around the ends of the developer roll and the developer housing.

Figure 2:
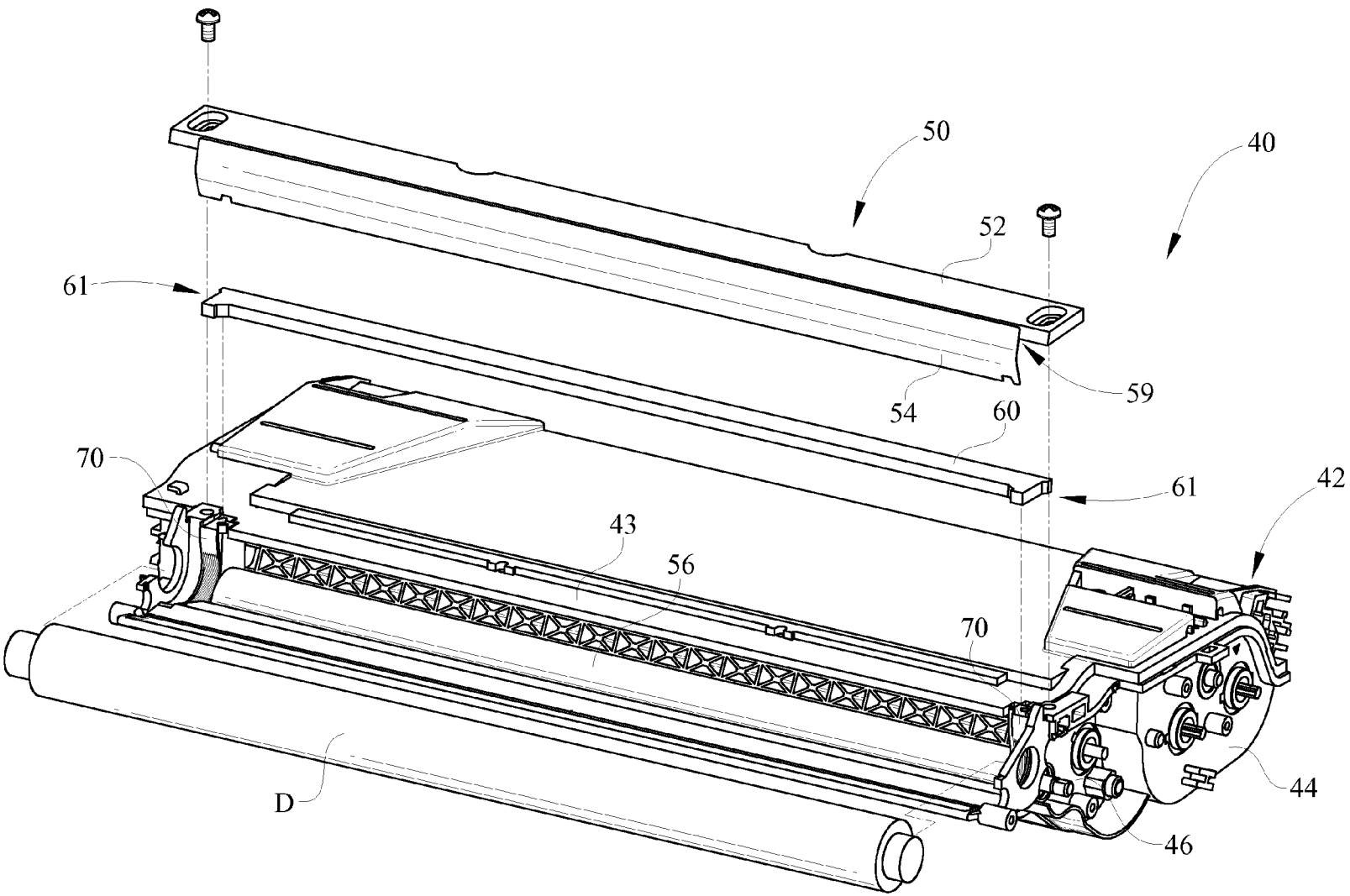
FIG. 2 depicts a partially exploded perspective view of a developer assembly.

Referring now to FIG. 1, a perspective view of a peripheral 10 having a laser printing mechanism is depicted in perspective view. Although, the peripheral device is depicted, one skilled in the art should realize that the present design may alternatively be used with an all-in-one device, copier, fax, stand-along device or the like having an electrophotographic (laser) print engine. The exemplary peripheral embodied by the laser printer 10, comprises a housing 12 including a primary access door 14 positioned on the top-front of the housing 12. The housing 12 generally comprises a front surface, first and second side surfaces, a rear surface (not shown) and a bottom surface to enclose the laser printer operating mechanisms. On the front of the housing 12, the primary access door 14 is pivotally mounted to allow opening and access for installation or removal of the fuser. The front panel of the primary access door 14 comprises an operations panel 16 which includes a display 18, an alpha numeric keypad 20, a plurality of selection buttons 22, as well as a flash memory slot 24. The operations panel 16 is in electronic communication with a controller (not shown), which may be embodied by one or more micro-processors, in order to operate the laser printer 10. Beneath the primary access door 14 is a secondary access door 26 which allows access to the developers or toner cartridges 40 (FIG. 2). The printer 10 may operate in both monochrome and color. For example, a black toner cartridge may be utilized, or a toner cartridge utilizing three colors such as cyan, yellow or magenta for color printing may be utilized.

Beneath the access doors 14, 26 is an input tray access door 30. When the input tray access door 30 is opened with a release 32, an input tray (not shown) is accessible to load the printer 10 with media. The input tray may hold a stack of media for printing and further defines a starting point of a media feedpath (not shown) extending from the media input tray to a media output tray 36. The media feedpath may be a duplex feedpath or a simplex feedpath. The media output tray 36 is located on top of the housing 12 and generally extends rearwardly to store printed media processed by the laser printer 10.

Referring now to FIG. 2, a developer assembly 40 is depicted in perspective view. The developer assembly 40 comprises a housing 42, formed of a first housing portion 44 and a second housing portion 46. Along at least one side of the housing 42 is a lid 43. Within the first housing portion 44, a plurality of toner is stored, and at least one paddle is located therein on a rotating shaft to move the toner from the first housing portion 44 toward the second housing portion 46. A toner adder roll 56 is located within or adjacent to the second housing portion 46, and receives toner therefrom. The toner adder roll 56 coats the developer roll D with toner, which is scraped or "doctored" by the doctor blade 54 to form an even layer of toner on the surface of the developer roll D, that in turn supplies toner to the imaging or photoreceptive drum. The lip seal structure (FIGS. 7-10) of the present embodiment inhibits leakage of toner in between the developer roll D, the doctor blade assembly 50, and the seal 70 when the developer housing 42 is dropped and also during operation when the developer unit 42 vibrates and creates internal pressures.

The developer assembly 40 comprises seals 70 at ends of the developer roll D. The developer roll D is exploded for clarity, so that the seals 70 may be seen. The seals 70 are substantially j-shaped to receive the doctor blade assembly 50 near the top and developer roll D near the bottom, although other curvilinear shapes may be utilized. Specifically, the upper portion of the j-seal 70 is slightly curved to substantially match the deflected shape of the doctor blade 54 while the lower portion of the j-seal 70 is curved to slidably receive the developer roll D. Disposed above the seals 70 is a doctor blade seal 60, which extends in a length that is parallel to the axial dimension of both the toner adder roll 56 and the developer roll D. Also disposed above the seals 70 is a doctor blade bracket assembly 50 comprising at least one bracket 52 and a doctor blade 54. Like the doctor blade seal 60, the doctor blade bracket assembly 50 also extends in a direction which is substantially parallel to the axial dimension of both the toner adder roll 56 and developer roll D. The doctor blade seal 60 is captured between the doctor blade bracket assembly 50 and either the j-seal 70 or the lid 43. The doctor blade 54 engages the developer roll to scrape excess toner from the surface of the developer roll, which provides a consistent level of toner to the imaging or photoreceptive drum of the printer 10. The doctor blade seal 60 is seated on the j-seals 70 to inhibit leakage of toner near ends of the developer roll and between the lid 43 and the developer housing 42. The doctor blade bracket assembly 50 compresses the doctor blade seal 60 to improve sealing in this area.

Figure 3:
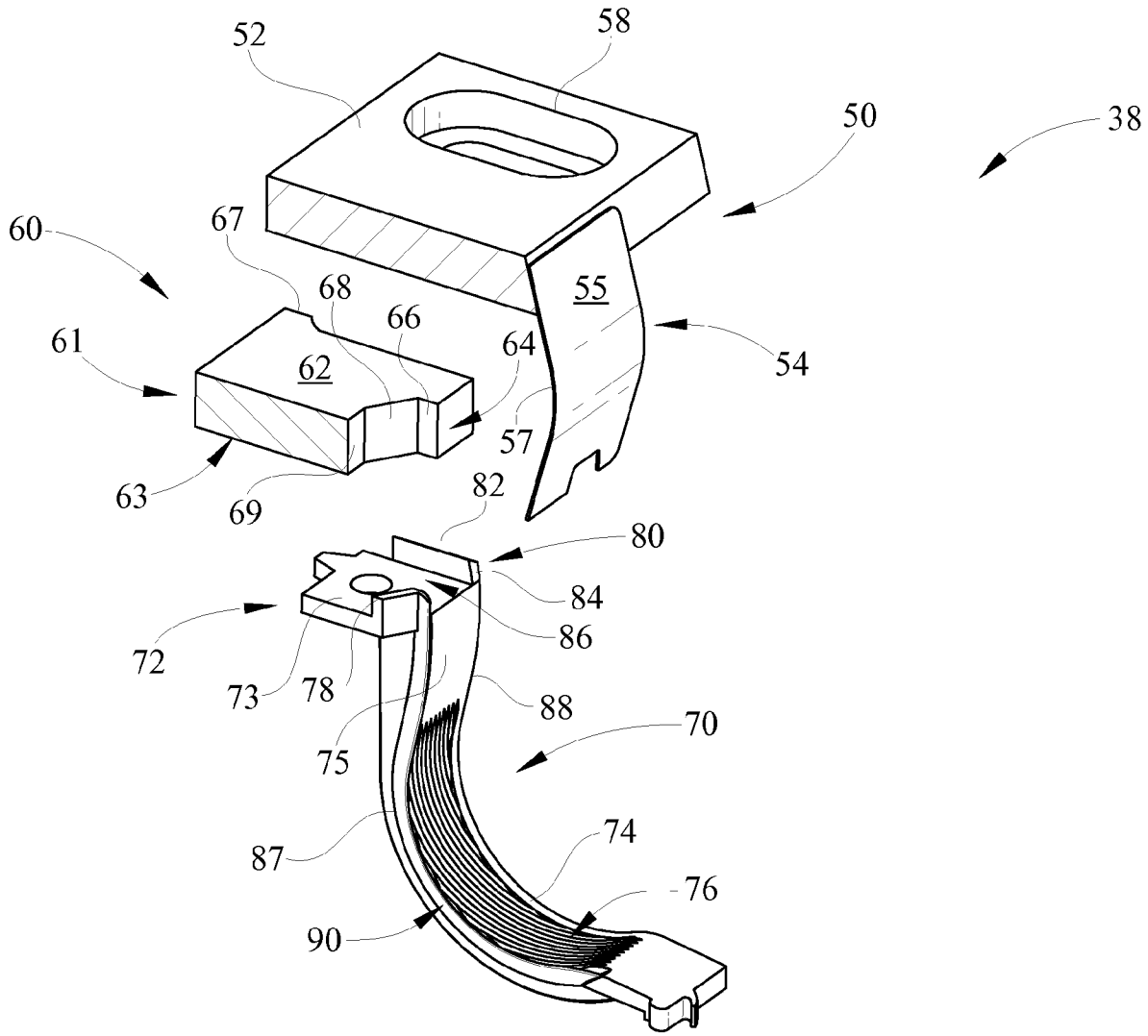
FIG. 3 depicts an exploded perspective view of a developer seal assembly from a first angle.

Referring now to FIG. 3, an exploded perspective view of the seal assembly 38 is depicted. The doctor blade bracket assembly 50 and the doctor blade seal 60 are cut in section for purpose of clarity. As previously indicated, the doctor blade bracket assembly 50 is disposed above the doctor blade seal 60 which is positioned above the j-seal 70. The doctor blade bracket assembly 50 comprises a bracket 52 and a blade 54 connected to the bracket 52. According to the exemplary embodiment, the blade 54 is welded to the bracket 52. However the bracket 52 may be connected to the blade 54 by a fixative such as epoxy, cement, glue or the like. In a further alternative, the blade 54 may be connected to the bracket 52 by a fastener or, the blade 54 may be captured or sandwiched between first and second bracket members. The bracket 52 includes an aperture 58 for connection of the doctor blade bracket assembly 50 to the housing 42. The aperture 58 is oval in shape so as to provide an adjustment for the blade 54 toward or away from the developer roll D. The bracket 52 is generally a stiff material such as steel and rectangular in shape extending from one side of the housing 42 to an opposed side of the housing 42. The bottom surface of the bracket 52 is generally smooth so as to engage the upper surface of the doctor blade seal 60.

The blade 54 extends from the bracket 52 toward a peripheral surface of the developer roll D in order to scrape excess toner from the outer surface of the developer roll D. The blade 54 is generally rectangular in shape having a long or widthwise dimension substantially parallel to the direction of the axial dimension of the developer roll. The blade 54 includes a front surface 55 and a rear surface 57. The blade 54 is straight in its natural state, but in order to provide a "doctoring" force on the developer roll D has a slight curvature due to interference with the developer roll D upon installation. In addition, the blade 54 has notches near ends of the blade for removing all toner from the ends of the developer roll D where printing does not occur. The blade 54 may also receive an electrical potential in order to charge the developer roll D with a desired polarity during operation. The lower surface of the bracket 52 engages an upper surface 62 of the doctor blade seal 60, so as to capture the seal 60 between the doctor blade assembly 50 and the j-seal 70. According to the exemplary embodiment, the blade 54 may be formed of phosphor bronze to provide the desired elasticity and electrical conductivity or alternatively may be formed of a hardened stainless steel to provide a desired elasticity and also withstand corrosion which might damage the developer roll. Other materials may also be utilized.

An end portion 61 of the doctor blade seal 60 is shown above one of the j-seals 70. The doctor blade seal 60 has first and second ends 61 (FIG. 2). As previously described, the doctor blade seal 60 extends between the ends 61 in a direction generally parallel to the axial dimension of the developer roll and the toner adder roll 56. The doctor blade seal 60 is formed of a foam material to act as a deformable seal between the bracket assembly 50 and the j-seal 70 or the lid 43, as well as around the housing 42 adjacent the j-seal 70 and between the bracket 52 and blade 54. The ends 61 are positioned on an upper seat surface 73 of the j-seal 70. The portion of the doctor blade seal 60 between the ends 61 is supported by the lid 43 of the housing 42 (FIG. 2).

The doctor blade seal 60 has an upper surface 62, a lower surface 63 and a plurality of sides extending between the upper and lower surfaces 62, 63. Along the front of the doctor blade seal 60, toward the doctor blade 54, a tongue 64 is integrally formed with and extending from the doctor blade seal end 61. On an outer side of the tongue 64 is an end surface 65 (FIG. 4) of the doctor blade seal 60. On the opposite surface of the tongue 64 near the blade 54, is a tongue extending surface 66. Angled from the tongue extending surface 66 is an angled or tapered surface 68. The angled surface 68 joins the tongue extending surface 66 and a front seal surface 69, which extends the distance of the doctor blade seal 60 to the opposite end 61 (not shown) of the doctor blade seal 60. Therefore, the tongue 64 generally extends from the angled surface 68 in a direction substantially perpendicular to the front seal surface 69. In combination, the surfaces 69, 68, 66 define a recess wherein an upper inner seat seal 78 of the J-seal 70 is received. As previously indicated, the doctor blade seal 60 extends in a width-wise direction, which corresponds to the width of a media sheet, and perpendicular to the media feed path direction to an opposite end of a seal 60 (not shown).

Beneath the doctor blade seal 60, the j-seal 70 comprises an upper seat portion 72, a front face including a doctor blade portion 75, and a developer roll leg 74, which is substantially j-shaped and depending from the upper seat portion 72. The seal 70 may be formed in a molding process, such as injection molding, compression molding, or other known processes for forming a plastic, or other elastomeric material such as a thermoplastic rubber, for example SANTOPRENE. The leg 74 has a front face 75 comprising a plurality of grooves 76, which provide several functions. The grooves 76 "snowplow" the toner on the developer roll and capture toner between the grooves to inhibit leakage. The grooves 76 also direct the toner toward a storage area via rotation of the developer roll D (FIG. 2). The grooves 76 are disposed at an angle, which may be from about zero to about forty-five degrees from the sidewall of the leg 74. However, according to one embodiment, the front face 75 may or may not include grooves 76, since the grooves 76 only slightly engage the developer roll D in order to dislodge toner particles therefrom.

The upper seat portion 72 comprises a seating surface 73, an upper seat inner seal wall 78 and an upper seat outer seal wall 80. A gap 86 is disposed between the upper seat inner and outer seal walls 78 and 80, wherein the tongue 64 of the doctor blade seal 60 may be positioned within the upper seat portion 72 to interlock the j-seal 70 and the doctor blade seal 60. The seating surface 73 also comprises an aperture made for receiving an alignment pin for proper positing of the j-seal 70 to the housing 42.

The upper seat inner seal wall 78 extends upwardly from the upper seat surface 73. The upper seat inner seal wall 78 is disposed at an angle which corresponds to that of the angled surface 68, so that the upper seat inner seal wall 78 and angled surface 68 engage one another in sealing fashion. Further, the upper seat inner seal wall 78 is received within the recess defined by the surfaces 66, 68, 69.

The exemplary seal 70 is depicted having a J-shape however, the seal 70 may comprise various curvilinear shapes. The seal 70 has an inner edge and an outer edge 87, 88 extending along sides of leg portion 74. The term inner means the side of the seal 70 towards the axial center of the developer roll D. The term outer means the side toward the axial ends of the developer roll D. The inner edges 87 of the seal 70 comprise a lip seal 90 which seals against the developer roll D to seal a leakage path which is active during drop testing and operation due to vibration. According to an alternative embodiment, the lip seal 90 may be positioned on an outer edge 88 of the leg 74. The lip seal 90 follows along the inner edge profile in order to define a substantially j-shape. The exemplary lip seal 90 is formed of a single molded element integrally with the j-seal 70. The lip seal 90 extends above the face 75 some preselected distance to insure engagement of the lip seal 90 and the developer roll D. Contrary to the lip seal 90, the outermost endpoints of grooves 76 have only a light engagement with the developer roll in order to dislodge the toner particles from the developer roll D. To the contrary, the lip seal 90 positively engages the developer roll D with the force developed by the bending of the lip seal 90 upon engagement with the developer roll D. Additionally, when a rear surface 92 of the lip seal 90 (FIG. 10) receives a force from the internal pressure in the cartridge housing 42, the lip seal 90 is pressed against the developer roll D increasing sealing against the developer roll D and the rear surface 57 of the blade 54. Thus, during operation or when the developer housing 42 is dropped, the developer roll D compresses the lip seal 90 increasing the sealing of the lip seal 90 so that toner cannot move through this area. The lip seal 90 extends from the upper seat portion 72 downwardly through the leg 74. The lip seal 90 may extend to the end of the leg 74 opposite the upper seat portion 72 or may extend to a position short of the end of leg 74. In either event, the lip seal 90 extends through at least some portion of the leg 74 wherein the developer roll D is positioned to provide slidable sealing contact therewith. In the exemplary embodiment, the lip seal 90 has a length that interferes with the developer roll surface between about 0.15 millimeters and about 0.5 millimeters. According to another exemplary embodiment, the lip seal 90 extends above surface 75 about 0.3 millimeters.

The lip seal 90 extends from the face 75 at an angle. The lip seal 90 may be disposed at between about 90 degrees and about 180 degrees from the face 75. Specifically, the angle of the lip seal 90 may be at between about 120 degrees and about 150 degrees from the face 75. This range may vary slightly depending on whether the angle is measured from the front or rear surface of the lip seal 90. This ensures that when a pressure builds inside the cartridge housing 42, either by operation or dropping, a component of this pressure is in the direction of interference of the lip seal 90 thereby increasing the sealing performance between the seal 90 and developer roll D. Additionally, the lip seal 90 may extend from the face 75 at an angle which varies moving along the inner edge 87 of leg 74.

The lip seal 90 provides an additional benefit. The manufacture of developer rolls by different manufacturers can result in variance in the outer diameter thereof. This variation in the outer diameter of the device is known as flare. The lip seal 90 has been determined to account for variation in roll diameters from different manufacturers which also provides improved sealing of toner along the leakage path about the developer roll D.

Figure 4:
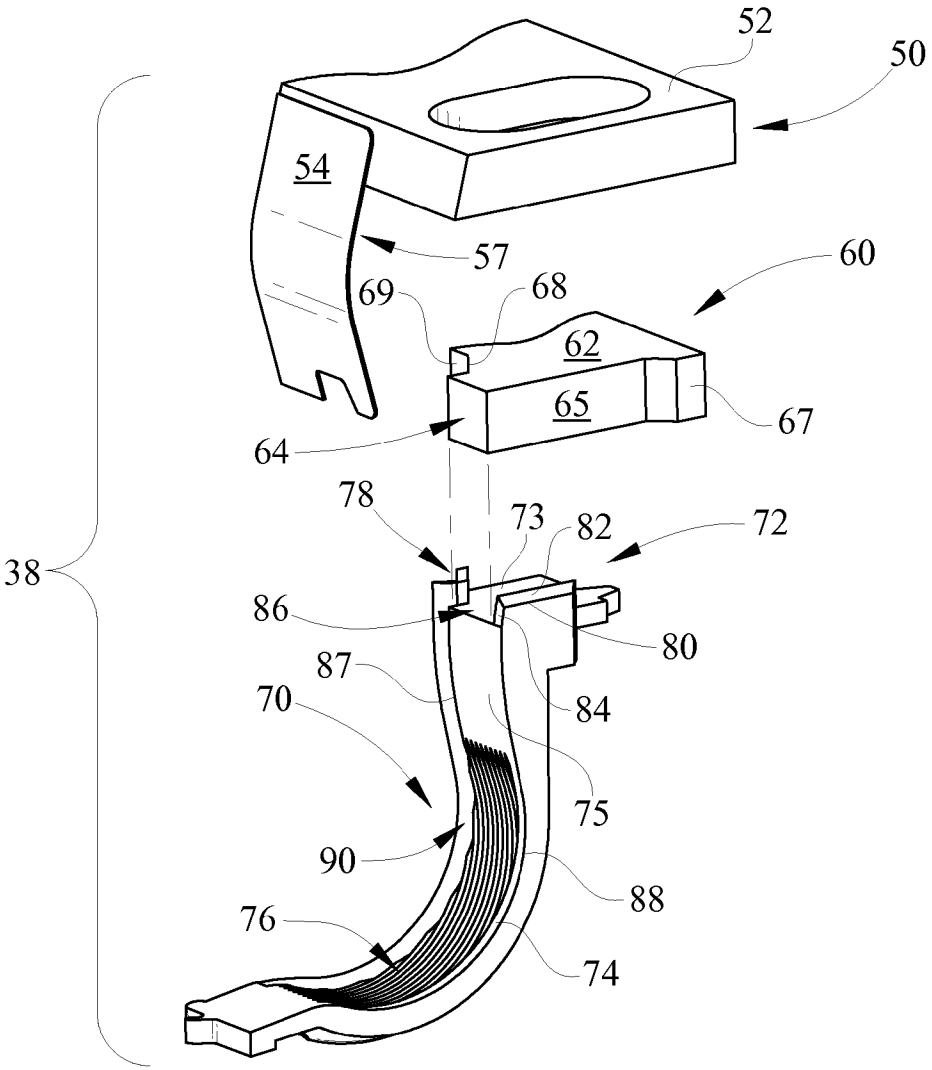
FIG. 4 depicts an exploded perspective view of a developer seal assembly from a second angle.

Referring additionally now to FIG. 4, the sealing assembly 38 is depicted from an opposite side as FIG. 3 and in an exploded perspective view. The upper seat outer seal 80 is depicted extending upwardly above the upper seat surface 73 and from a front edge 75 of the j-seal 70 rearwardly. The upper seat outer wall 80 comprises an upper tapered horizontal edge 82 and a tapered vertical edge 84. When the bracket assembly 50 is located on the doctor blade seal 60, the seal 60 compresses within the j-seal upper seat 72. Due to this compression, the lower surface of the bracket 52 engages the tapered horizontal edge 82. Since the upper edge 82 of the upper seat outer seal wall 80 is tapered, the downward force on the edge 82, caused by the bracket assembly 50, results in an inwardly directed component force which pushes the upper seat outer seal wall 80 inwardly against the doctor blade seal 60. This causes increased sealing performance along the interface between the j-seal 70 and the end surface 65 of the doctor blade seal 60. The upper outer seat seal wall 80 also comprises a curved vertical edge which matches the profile of the blade 54 to engage the rear surface of the blade 54.

Also extending from the end surface 65 of seal 60 is an edge rib 67. The rib 67 is deformed so as to be positioned over an edge of the housing wherein the j-seal 70 is seated. Since the rib 67 extends outwardly from the end surface 65, the upper seat outer seal wall 80 does not extend rearwardly the entire length of the seating surface 73. Accordingly, space is provided for the edge rib 67 to extend outwardly beyond the upper seat outer seal wall 80.

Figure 5:
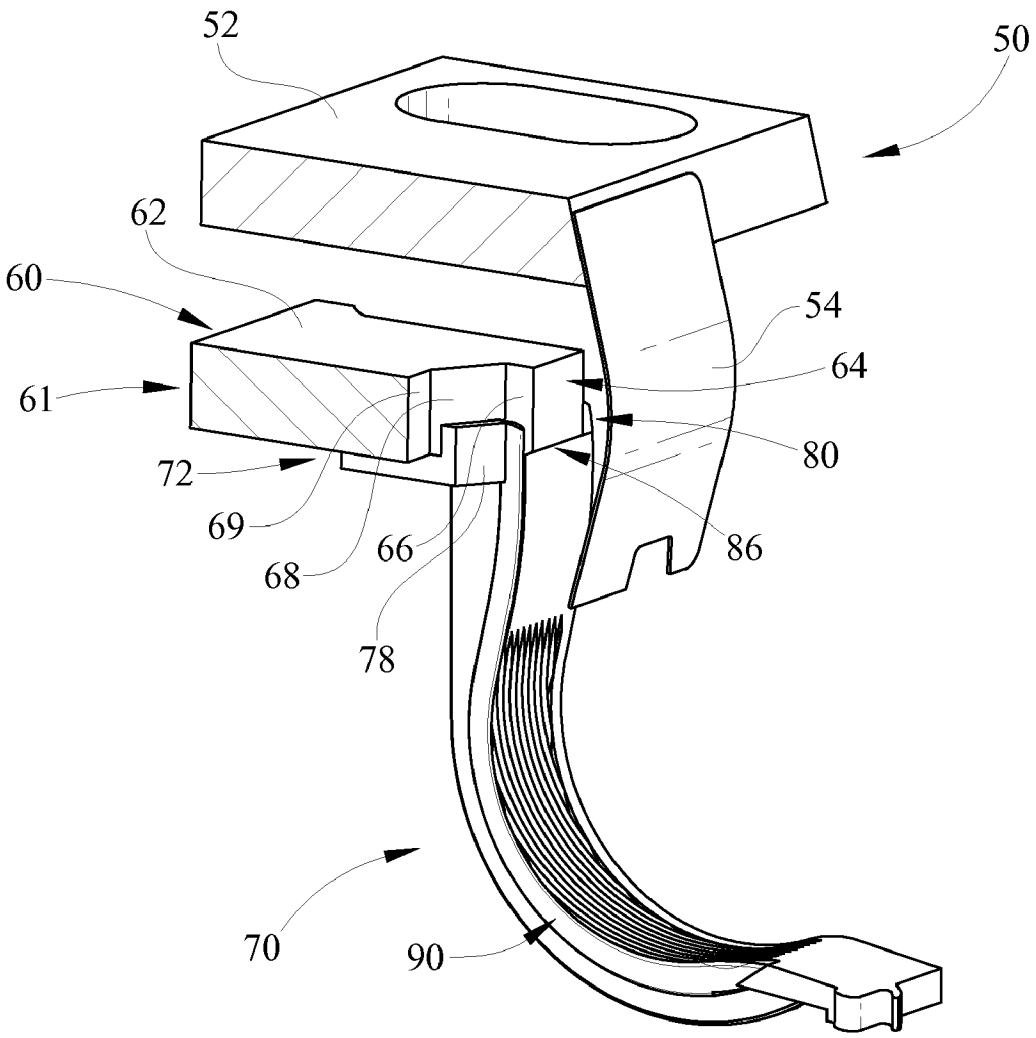
FIG. 5 depicts one end of a partially assembled developer seal assembly.

Referring now to FIG. 5, a perspective view of the assembly 38 is depicted with the doctor blade seal 60 positioned in the upper seat portion 72. The upper seat inner seal wall 78 is disposed within the recess defined by surfaces 66, 68, 69. Further, the angled surface 68 is engaging the upper seat inner seal wall 78. When the bracket assembly 50 is lowered on the doctor blade seal 60, the doctor blade seal 60 is compressed so that the seal surfaces 66, 68, 69 expand to engage the inner seal wall 78. The tongue 64 of the doctor blade seal 60 is extending through the j-seal gap 86.

Referring to FIGS. 3-5, the lip seal 90 extending from the j-seal 70 engages both the developer roll D and the rear surface 57 of blade 54. Upon receiving a force from internal pressure of the cartridge 42, the lip 90 is pressed against the blade 54 and the developer roll D to improve sealing performance. Thus the lip seal 90 uses the internal forces of the cartridge 42 to seal against the blade 54 and developer roll D. Also, the lip seal 90 is forced against a lower developer seal, which is not shown when receiving the force caused by internal pressure of the cartridge. Therefore the lip seal 90 generally improves sealing performance along its entire length about the developer roll whether by direct engagement with the developer roll or engagement with the blade 54 or engagement with the lower developer seal (not shown).

Figure 6:
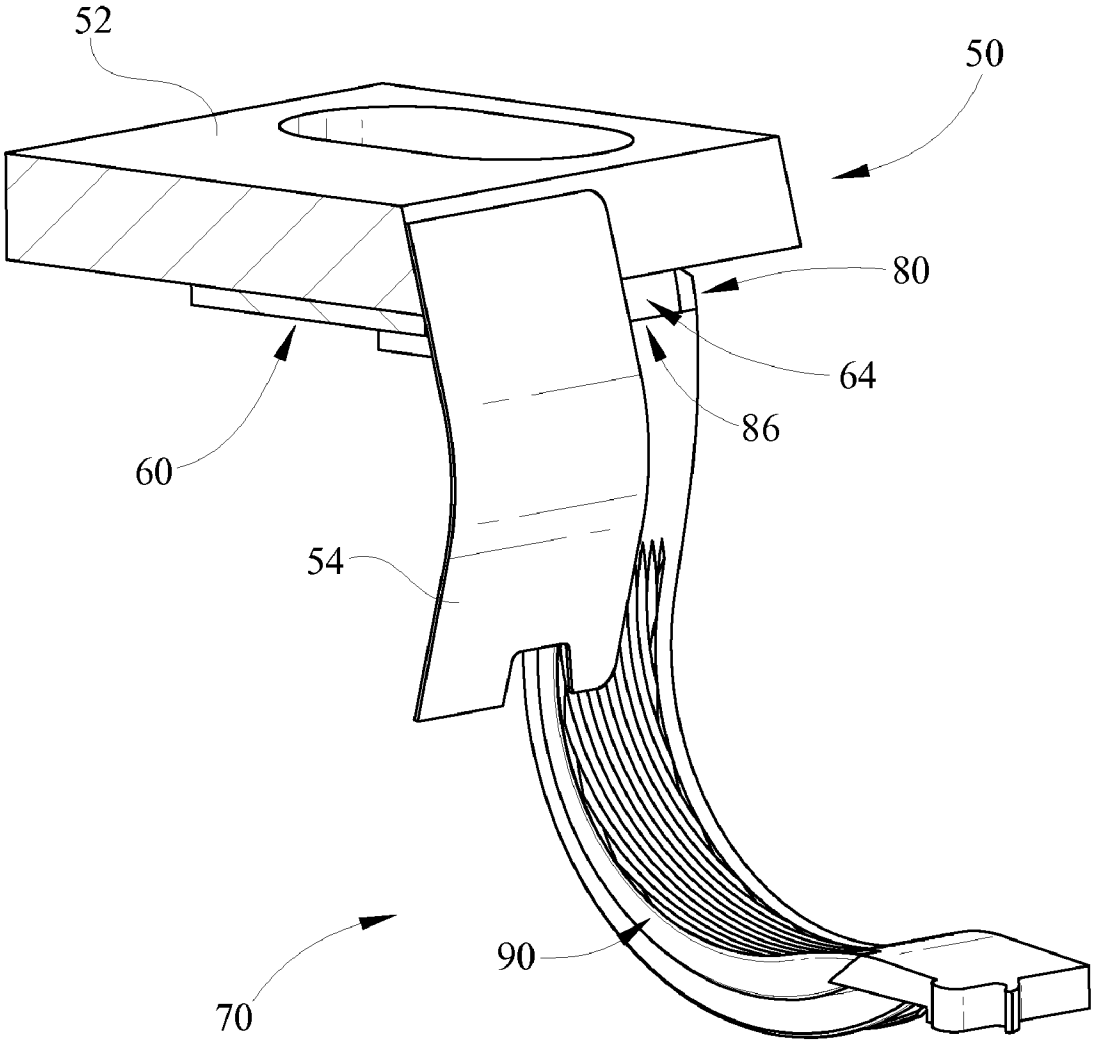
FIG. 6 depicts one end of the developer seal assembly.

Referring now to FIG. 6, the bracket assembly 50 is positioned on the doctor blade seal 60. The down force of the assembly 50 which is tightened against the housing 42 (FIG. 2) compresses the doctor blade seal 60. The compressing of the doctor blade seal 60 also forces the doctor blade seal 60 into the corner defined at the junction between the doctor blade 54 and the bracket 52 inhibiting leakage from that path. Additionally, the bracket assembly 50 engages the horizontal edge 82, providing an inwardly directed force on the upper seat outer seal 80 to improve sealing along the interface between the doctor blade seal 60 and the j-seal 70.

Figure 7:
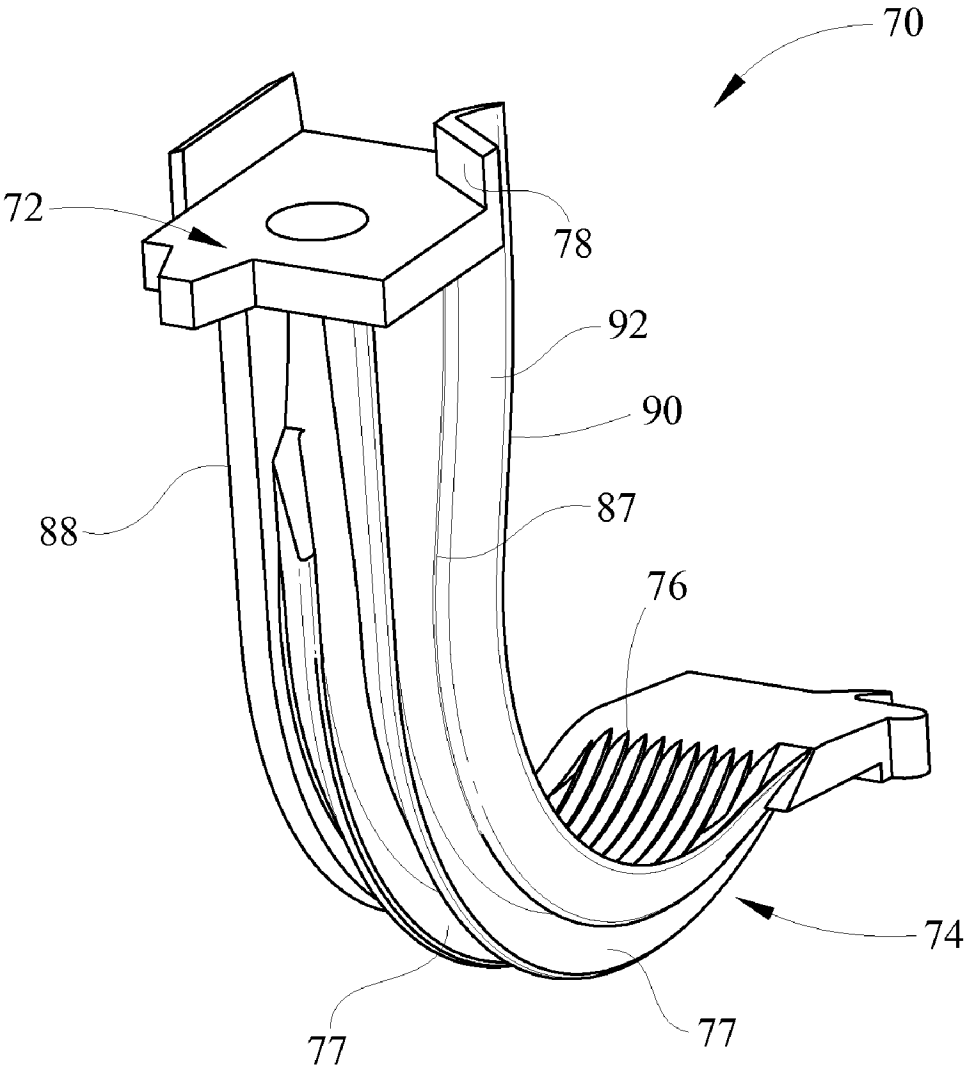
FIG. 7 depicts a rear perspective view of the j-seal.

Referring now to FIG. 7, a rear perspective view of the j-seal 70 is depicted. The j-seal 70 comprises at least one rib 77 extending from a rear surface of the j-seal 70 which functions to cushion the j-seal 70 against the housing 42. The ribs 77 have been optimized to create an even pressure distribution between the developer roll D and the j-seal 70. As a result the grooves 76 provide an even pressure against the developer roll D. The at least one rib 77 is integrally molded with the j-seal 70, although other constructions may be utilized. The at least one rib 77 may also have a secondary function of stiffening the j-seal 70.

The lip seal 90 is also shown extending from the inner edge 87 of the seal 70. A rear surface 92 of the lip seal 90 is depicted. The figure depicts the lip seal 90 extending inwardly, in the direction of the center of the developer roll, at an angle directed from the upper seat inner seal wall 78. At the upper portion of the seal 70, the lip seal 90 and the upper seat inner seal wall 78 are joined to provide a sealed area extending from the seat portion 72 downwardly along the developer roll D.

Figure 8:
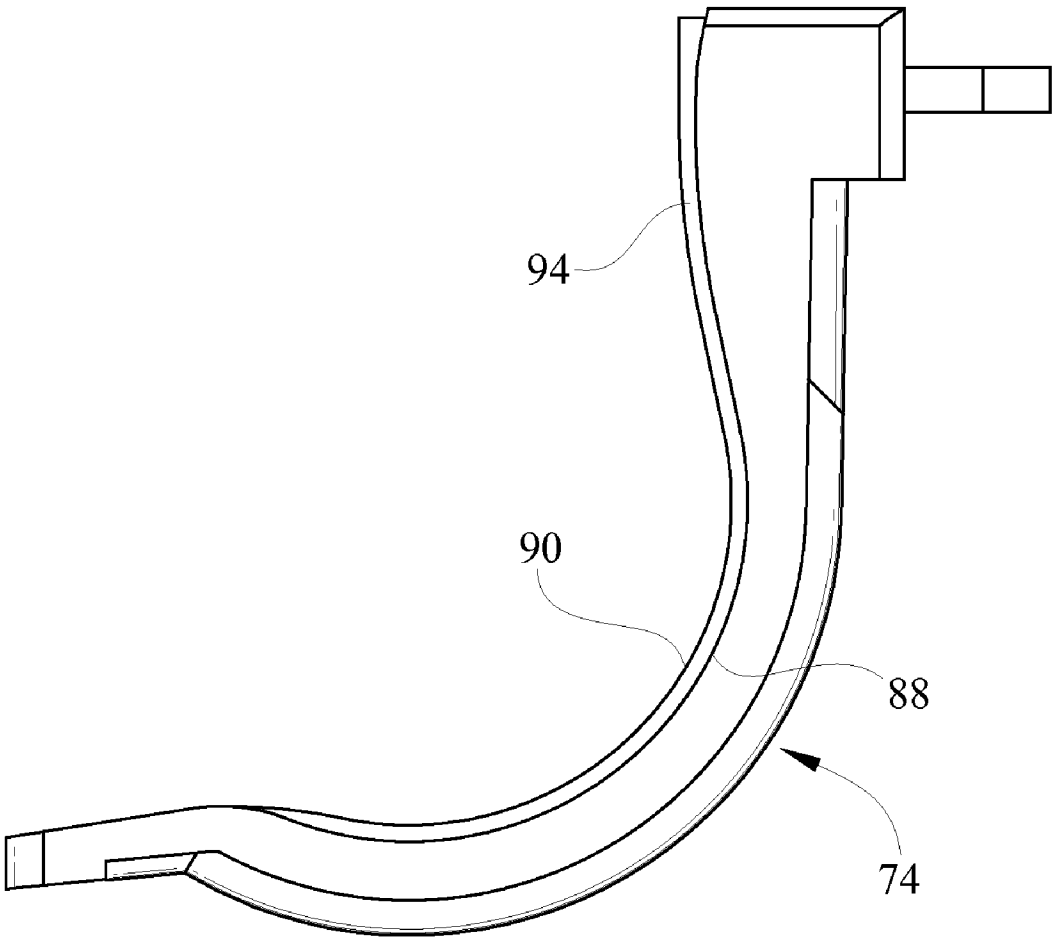
FIG. 8 depicts a side view of the j-seal.

Referring now to FIG. 8, a side view of the curvilinear seal 70 is depicted. The exemplary seal 70 is J-shaped as previously described although it may comprise alternative shapes. The lip seal 90 clearly extends radially inward beyond the face 75 of leg 74 to effect engagement with the developer roll D. A front surface 94 of the lip seal 90 is depicted extending into the curved portion of leg 74. Contrary to the grooved face 75 which only lightly engages the developer roll D, the lip seal 90 positively slidably and sealably engages the developer roll D with a preselected force in order to inhibit leakage through that path. As a result, in drop testing and operational testing, the lip seal 90 improves sealing of toner and inhibits leakage about the developer roll D.

Figure 9:
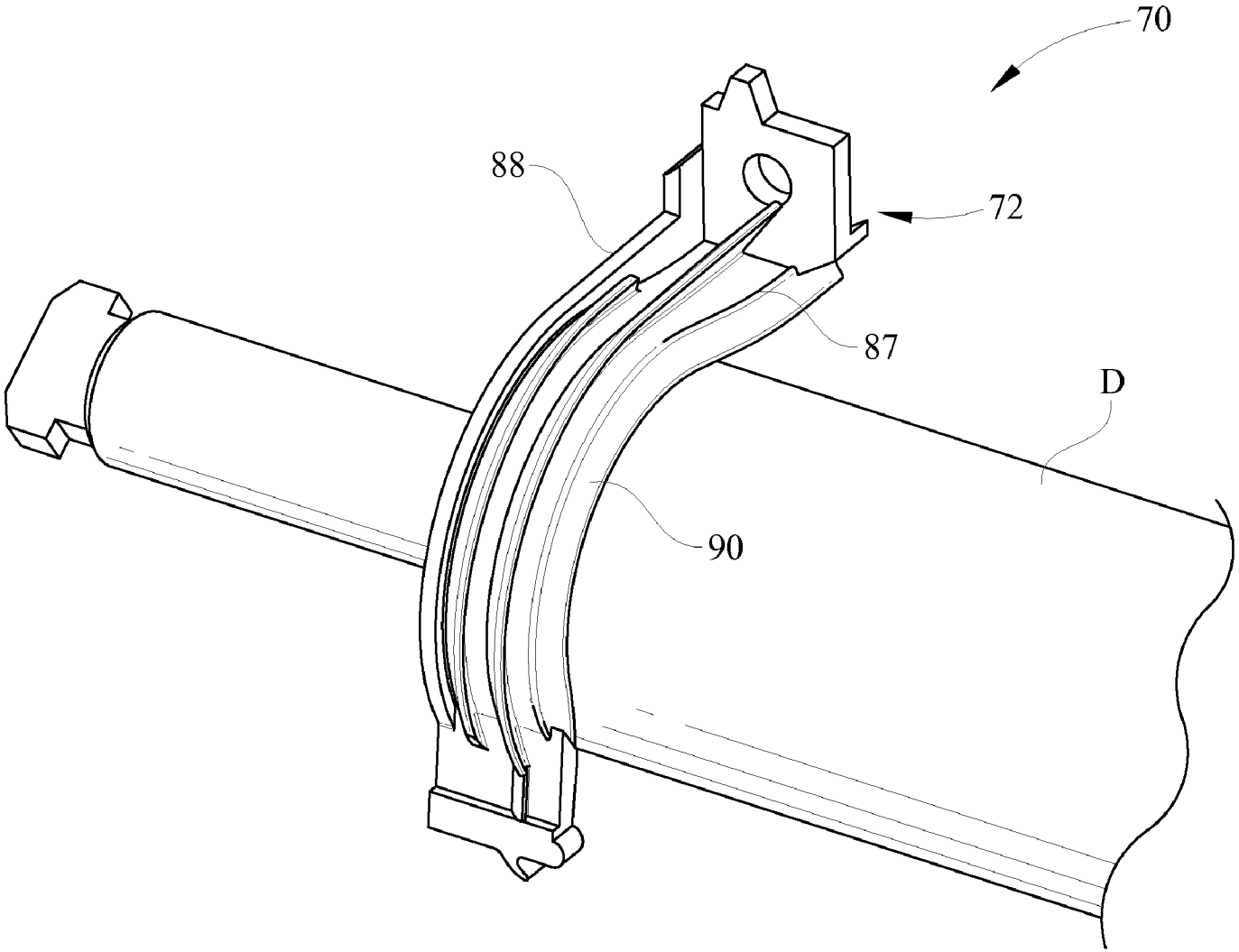
FIG. 9 depicts a rear perspective view of the j-seal and lip seal slidably engaging the developer roll; and, FIG. 10 depicts a top view of the j-seal.

Referring now to FIG. 9, a rear perspective view of the j-seal 70 is shown with the lip seal 90 engaging the developer roll D. As may have been clear from the previous drawings, the J-shaped seal 70 does not extend completely, three hundred sixty degrees, about the developer roll D. However, the sealing characteristics of the lip seal 90 are such that the seal 70 need not completely surround the developer roll D. FIG. 9 also depicts the flexing of the lip seal 90 upon engagement of the developer roll D. Deflection of the lip seal 90 creates a deflection force which causes the lip seal 90 to engage the developer roll D. The engagement of the lip seal occurs along nearly the entire curved portion of the j-seal 70.

Figure 10:
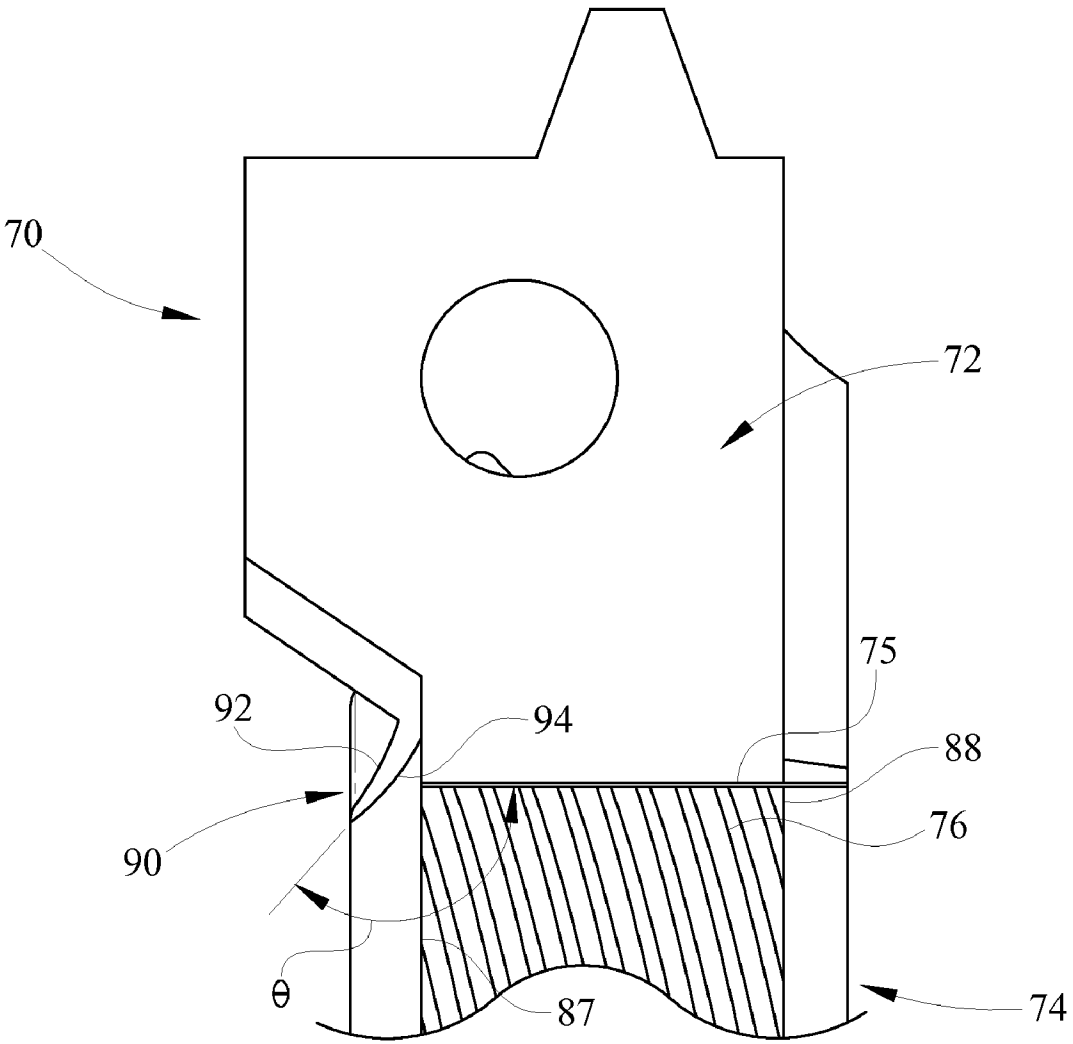

Referring now to FIG. 10, a top view of the seat portion 72 is depicted. The top view provides a view of the exemplary crab-claw shape of lip seal 90. The seal 90 comprises a first surface 92 positioned closest to and generally extending from the upper seat inner seal wall 78. Opposite the first surface 92 is the second surface 94. The first and second surfaces 92, 94 have slight curvature for receiving the developer roll D and allowing bending upon installation about the developer roll D. The lip seal 90 is tapered from a thicker end at the edge 87 to a thinner end away from the edge 87. In general, the lip seal 90 is designed with a thickness, between the converging surfaces 92, 94, which is less than the length, measured from the edge 87 to the end of the lip seal 90. This allows the seal 90 to interfere with the developer roll D a considerable amount without creating an excessively high radial load thereby minimizing torque and heat generation. The first surface 92 receives a force caused by internal pressures within the cartridge 42 forcing the seal 90 against the developer roll D, thereby increasing sealing performance. The first and second surfaces 92, 94 form an arcuately or slightly curved shaped seal in cross section which engages the developer roll D, as depicted in FIG. 9, although alternative seal cross-sectional shapes may be utilized. The figure also depicts the angle of the lip seal 90 extending from the edge 87 of the j-seal 70 from the seat portion 72 through the lower portion of the leg 74. As previously indicated, the lip seal 90 may be disposed at an angle θ between about 90 degrees and about 180 degrees from a vertical portion of the face 75. In the figure, the face 75 is generally indicated as a double line due to slight curvature of the surface but represents a reference surface, for purpose of the measurement, which includes at least in part a substantially vertical surface portion. More specifically, the angle θ between the lip seal 90 and the vertical portion face 75 may be at between about 120 degrees and about 150 degrees. This range may vary slightly depending on whether the angle θ is measured from the first (rear) or second (front) surface of the lip seal 90.

The foregoing description of the various embodiments of the invention has been presented for purposes of illustration. It is not intended to be exhaustive or to limit the invention to the precise steps and/or forms disclosed, and obviously many modifications and variations are possible in light of the above teaching. It is intended that the scope of the invention be defined by the claims appended hereto.

What is claimed is:

1. A toner seal, comprising:

a j-shaped seal having an upper seat portion and a leg portion depending from said upper seat portion, said leg portion having a front face section having an end extending from said upper seat portion and a developer leg section continuously extending from an opposite end of said front face section, the front face section having a first curvature and the developer leg section having a second curvature oppositely curved with respect to said first curvature such that said leg portion has a substantially smooth curvilinear profile extending from said upper seat portion; said second curvature of said developer leg section slidably engaging a portion of a surface of a developer roll; and a lip seal extending from said upper seat portion along at least one of a first edge and a second edge of said leg portion and extending above a front surface of said leg portion the lip seal having a curvilinear profile matching said smooth curvilinear profile of said leg portion, said lip seal having a first and second sections that are continuously connected with each other, said first section is disposed along said developer leg section for sealably engaging the portion of the surface of the developer roll and said second section is disposed along said front face section for sealably engaging a rear surface of a blade member.

2. The toner seal of claim 1, wherein said upper seat portion includes an upper seal wall extending upwardly from a seating surface thereof and said lip seal is connected to said upper seal wall to provide a sealing surface extending from said upper seal wall above said upper seat section downwardly along said leg portion.

3. The toner seal of claim 1, further comprising at least one rib extending along a rear surface of said leg portion from a bottom surface of said upper seat portion towards an end of said leg portion, said at least one rib being resilient to provide biasing support for said developer leg section toward the portion of the surface of the developer roll.

4. The toner seal of claim 1, wherein said lip seal has a length extending from said upper seat portion to a location short of an opposite end of said leg portion.

5. The toner seal of claim 1 wherein said j-shaped seal is formed of an elastomeric material.

6. The toner seal of claim 1, wherein said lip seal extends beyond a front surface of said leg portion with a distance of about 0.3 millimeters.

7. The toner seal of claim 6, wherein said lip seal extends radially and at an angle from said front surface of said leg portion.

8. The toner seal of claim 1, further comprising a plurality of grooves disposed on said front surface of said developer leg section of said leg portion and at angle from one of said first and second edges of said leg portion for engaging with said developer roll and dislodging toner particles therefrom.

9. A toner seal disposed within a toner housing and engaging a developer roll, comprising:

a j-shaped seal having an upper seat portion and a leg portion depending therefrom, said leg portion having a inner edge and an outer edge and a front surface extending between said outer and inner edges, said leg portion further having a front face section extending from said upper seat portion with a first curvature and a developer leg section continuously extending from an end of said front section, the developer leg section having a second curvature oppositely curved with respect to said first curvature such that said front surface of said leg portion has a substantially smooth curvilinear profile that extends from said upper seat portion;

a plurality of grooves disposed along said front surface of said developer leg section; and a lip seal extending along the length of said inner edge, said lip seal receiving a force from internal pressure of said toner housing and sealably engaging said developer roll and a doctor blade.

10. The toner seal of claim 9, wherein said lip seal extends a distance above said front surface of said leg portion ranging from about 0.15 to about 0.5 millimeters.

11. The toner seal of claim 9, further comprising at least one rib extending along a rear surface of said leg portion from an underside of said upper seat portion towards an end of said leg portion, said at least one rib being resilient to provide biasing support for said leg portion of said toner seal.

12. The toner seal of claim 9, wherein said lip seal extends from said upper seat portion downwardly towards an end of said leg portion such that said lip seal substantially matches said smooth curvilinear profile of said leg portion, said lip seal having a first section disposed along said developer leg section for sealably engaging a lateral portion of said developer roll and a second section continuously connected with said first section and disposed along said front face section for sealably engaging a rear surface of a blade member.

13. The toner seal of claim 9, wherein said upper seat portion includes an upper seal wall extending upwardly from a seating surface thereof and said lip seal is connected to said upper seal wall to provide a sealing surface from above said upper seat portion downwardly along said leg portion.

14. A toner seal structure, comprising:

a curvilinear seal having an upper seat and a leg depending at an angle from said upper seat, said leg having an outer edge, an inner edge, a front surface extending between said inner edge and said outer edge, and a curved portion; and a lip seal extending from said upper seat to an end of said leg along said outer edge of said leg;

wherein said curved portion of said leg includes continuously connected first and second curvatures that are oppositely curved with respect to each other such that each of said front surface of said leg and said lip seal has a substantially smooth curvilinear profile that extends from said upper seat.

15. The toner seal of claim 14, further comprising a plurality of grooves located on a portion of said front surface of the curved portion of said leg.

16. The toner seal of claim 14 wherein said curvilinear seal structure is molded.

17. The toner seal of claim 14, wherein said lip seal includes a first section along said first curvature for sealably engaging a developer roll surface and a second section along said second curvature for sealably engaging a rear surface of a blade member.

18. The toner seal of claim 14, wherein said lip seal projects from said front surface.

19. The toner seal of claim 9, wherein said lip seal projects from said front surface at an angle ranging from about 120 degrees to about 150 degrees.

20. The toner seal of claim 14, wherein said upper seat includes an upper seal wall extending upwardly from a seating surface thereof and said lip seal is connected to said upper seal wall to provide a continuous sealing surface from above said upper seat downwardly along said leg.

21. The toner seal of claim 14, further comprising at least one rib extending along a rear surface of leg of said upper seat towards an end of said leg, said at least one rib being resilient to provide biasing support for said toner seal.

* * * * *